United States Patent [19]

Hemphill

[11] 4,141,728

[45] Feb. 27, 1979

[54] TRANSFER OF DRY DEVELOPED ELECTROSTATIC IMAGE USING PLURAL OPPOSITELY CHARGED FIELDS

[75] Inventor: Kent W. Hemphill, Rochester, N.Y.

[73] Assignee: Xerox Corporation, Stamford, Conn.

[21] Appl. No.: 812,870

[22] Filed: Jul. 5, 1977

[51] Int. Cl.[2] ..... G03G 13/16

[52] U.S. Cl. ..... 96/1.4; 96/1 SD; 96/1.3

[58] Field of Search ..... 96/1.4, 1 SD, 1.3

[56] References Cited

U.S. PATENT DOCUMENTS

| | | | |
|---|---|---|---|
| 3,877,934 | 4/1975 | Schmidlin | 96/1.4 |
| 4,014,605 | 3/1977 | Fletcher | 96/1.4 X |

*Primary Examiner*—John D. Welsh

[57] ABSTRACT

An improved method of transferring an electrostatically developed image from a photoreceptor to a transfer member (e.g., a sheet of paper) in contact with the image including simultaneously (1) charging the transfer member to a polarity opposite to that of the toner forming the developed image, (2) exposing a photoconductive surface of the photoreceptor to light, and (3) charging the photoconductive surface to the same polarity as that of the toner particles.

6 Claims, 6 Drawing Figures

TRANSFER OF DRY DEVELOPED ELECTROSTATIC IMAGE USING PLURAL OPPOSITELY CHARGED FIELDS

BACKGROUND OF THE INVENTION

The present invention relates to an improved method of transferring an electrostatic developed image from a photoreceptor to a transfer member in contact with the image. More particularly, the invention is directed to a method for charging the transfer member to a polarity opposite to that of the toner forming the developed image while simultaneously charging the photoreceptor to the same polarity as that of the toner particles.

In conventional xerography, a xerographic member comprising a layer of photoconductive insulating material affixed to a conductive backing is used to support electrostatic latent images. In the xerographic process, the photoconductive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., a sheet of paper), and the image is affixed thereto to form a permanent record of the original document.

In the practice of xerography, the transfer member is caused to move into synchronized contact with the developed image during the transfer operation, and an electrical potential opposite from the polarity of the toner is applied to the side of the transfer member remote from the photoconductive surface to electrostatically attract the toner image from the surface to the transfer member. With this conventional method, however, the transfer fields are generally not sufficient to overcome all of the forces at the toner-photoreceptor interface, thus leaving larger amounts of charged residual toner than desired on the photoconductive surface to be cleaned. Because larger amounts of toner are left on the photoreceptor than desired, slightly higher development is required to compensate for the untransferred toner, thus increasing the amount of toner needed to develop a given number of latent images. Consequently, what is needed is a more efficient method of transferring developed images, one which transfers a greater percentage of toner from the photoreceptor to a transfer member than do conventional methods.

Consequently, a primary object of the present invention is to provide a transfer method which is more efficient than conventional methods, a method which produces higher toner-photoreceptor transfer fields than conventional methods.

SUMMARY OF THE INVENTION

The present invention is directed to an improved method of transferring electrostatic developed images from a photoreceptor to a transfer member which overcomes the problems discussed above. The methods include the simultaneous steps of charging the transfer member to a polarity opposite to that of the toner forming the developed image, exposing a photoconductive surface of the photoreceptor to light, and charging the photoconductive surface to the same polarity as that of the toner. Transferring an image in this method is more efficient than conventional transfer methods because a greater transfer field is created because the forces on the transfer member and the forces on the photoconductive surface are both acting to force toner toward the transfer member; this is not true with conventional transfer methods wherein the photoconductive surface retains a charge having the same polarity as that on the transfer member.

DESCRIPTION OF THE INVENTION

Figure 1:
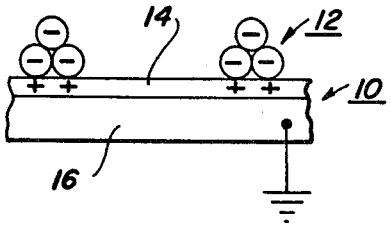
FIG. 1 shows a conventional pre-transfer state with a positive latent image which has been developed with negatively charged toner.
Figure 2:
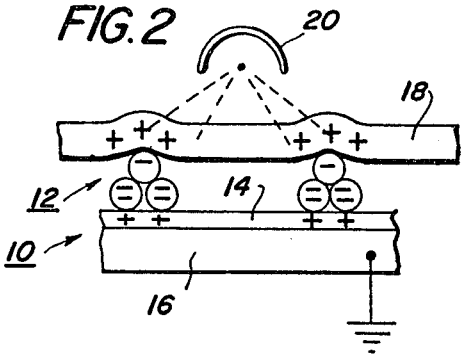
FIG. 2 shows the charge condition during a conventional transfer operation.

The following discussion relates to the type of electrostatic reproduction machine in which the present invention may be used. As in all electrostatic reproduction machines of this type, a light image of an original is projected onto the photoconductive surface of a charged photoreceptor to form an electrostatic latent image thereon. Thereafter, the latent image is developed with an oppositely charged developing material comprising carrier beads and toner particles triboelectrically adhering thereto to form a xerographic powder image corresponding to the latent image on the photoconductive surface. The powder image is then electrostatically transferred to a transfer member such as a sheet of paper to which it may be fixed by fusing device whereby the toner image is caused to adhere to the transfer member.

Discussing this type of machine more specifically, an original to be copied is placed upon a transparent support platen fixedly arranged in an illumination assembly. While upon the platen, the illumination assembly flashes light rays upon the original, thereby producing image rays corresponding to the informational areas on the original. The image rays are projected by means of an optical system to an exposure station for exposing the surface of a moving photoreceptor which may be in any suitable form such as a drum or a flexible belt. Prior to reaching the exposure station, that portion of the photoreceptor being exposed would have been uniformly positively charged by a corona generating device. In the example described herein, it will be assumed that the photoreceptor has been positively charged although the present invention is also applicable to a xerographic member which has been negatively charged.

The exposure of the photoreceptor to the light image discharges the surface in the areas struck by light whereby an electrostatic latent image remains on the photoreceptor in image configuration corresponding to the light image projected from the original on the support platen. As the photoreceptor continues its movement, the latent image passes through a developing station where a developing apparatus is positioned. The developing apparatus causes negatively charged toner to be applied to the latent image to produce an electrostatic developed image on the photoconductive surface of the photoreceptor.

The developed image is transported by the photoreceptor to a transfer station where a transfer member is moved into contact with the developed image at a speed in synchronism with the photoreceptor in order to effect transfer of the developed image. The back side of the transfer member is positively charged by a corona generating device or electrically biased transfer roll as the transfer member is moved into contact with the developed image so that the developed image on the photoreceptor may be electrostatically attracted to the transfer member as the latter is brought into contact therewith. Everything that has been discussed up to this point including the transfer operation is conventional. The present invention, however, proposes to also reverse the polarity of the charge on the photoconductive surface during transfer, i.e., change the charge from positive to negative. This will be described in more detail below.

As the transfer member emerges from the transfer station, the transfer member is removed from the photoreceptor by a stripping mechanism and is transported into a fuser assembly where the developed image on the transfer member is permanently affixed thereto. After fusing, the finished copy is discharged at a suitable point for collection. The toner remaining as residue on the photoreceptor is carried by the photoreceptor to a cleaning apparatus where the residue is removed before the photoreceptor is charged once again.

Referring to FIGS. 1 through 4, the present invention will be described in detail. FIG. 1 shows a conventional pre-transfer state for the example used herein wherein a positively charged latent image on a photoreceptor 10 has been developed with negatively charged toner 12. The photoreceptor is comprised of a photoconductive layer 14, and a grounded conductive substrate 16. When the developed image arrives at a transfer station, a transfer member 18 in contact with the image is charged positively by a corona generating device 20 or other suitable charging means. The positive charge on the transfer member will be of a greater magnitude than the positive charge on the latent image. With this conventional arrangement, however, it can be seen that transfer efficiency is controlled by the magnitude of two competing forces, i.e., the field due to the charge on the transfer member which attracts the toner thereto, and the field due to the latent image charge which attracts the toner to the photoreceptor. The problems resulting from this arrangement were discussed above, and it is these problems to which the present invention is directed.

Figure 3:
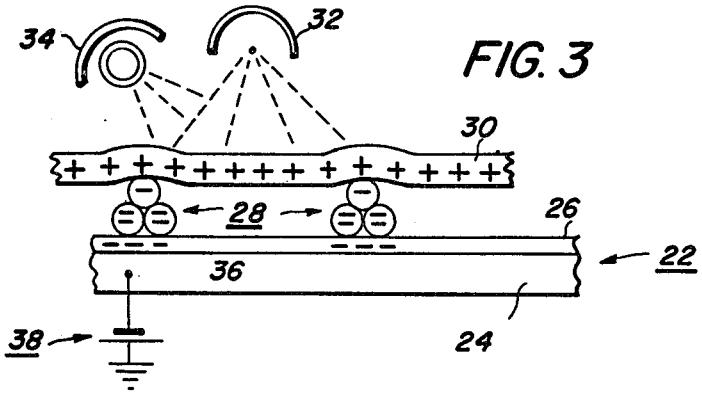
FIG. 3 shows an internal charge of like polarity being applied to a photoconductive surface in accordance with the present invention.

Referring to FIG. 3, and using the same example of a photoreceptor having a positively charged latent image developed by negatively charged toner, the present invention will now be described. A photoreceptor 22 is comprised of a conductive substrate 24 and an ambipolar photoconductive layer 26. A suitable material for the photoconductive layer 26 is described in U.S. Pat. No. 3,954,906, the latter being incorporated by reference herein. U.S. Pat. No. 3,954,906 teaches such material can be incorporated into an imaging member in an electrostatographic imaging system and function in either a positive or negative charging mode. As the developed image is moved through a transfer station, three steps occur simultaneously to effect transfer of the toner image 28 to a transfer member 30: the transfer member is positively charged by a transfer corona generating device 32, the photoconductive layer 26 is exposed to a light source 34 to render the layer conductive and to discharge the background areas 36 adjacent to the toner image, and the photoconductive layer 26 is reverse biased by a negative voltage source 38 to negatively charge the layer. As opposed to conventional transfer methods, it can be seen that with the present invention both fields now act to force the toner image 28 toward the transfer member 30; consequently more of the toner is transferred to the transfer member 30.

Figure 4:
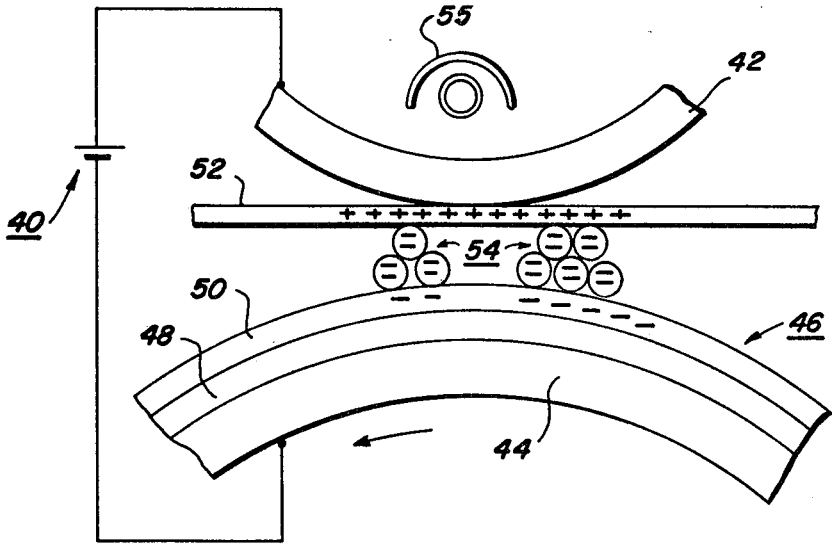
FIG. 4 shows an internal charge of like polarity being applied to a photoconductive surface by an electrically biased transfer roll in accordance with the present invention.

Referring to FIG. 4, the preferred embodiment of the present invention using an electrically biased transfer roll will be described. A voltage source 40 positively biases a transfer roll 42 (made of a suitable transparent conductive material such as NESA glass), and negatively biases a conductive rubber roll 44. The roll 44 along with at least one other roll supports a flexible belt-type photoreceptor 46 for movement around a closed path. The photoreceptor is again comprised of a conductive substrate 48, and an ambipolar photoconductive layer 50 which may be made of the same material described above. As a developed image is moved through a transfer station, the same three steps described above in reference to FIG. 3 occur simultaneously: a transfer member 52 in contact with the developed image is positively charged to attract the negatively charged toner 54 toward the transfer member, and the photoconductive layer 50 is negatively charged while being exposed to a suitable light source 55 through transfer member 52.

Figure 5:
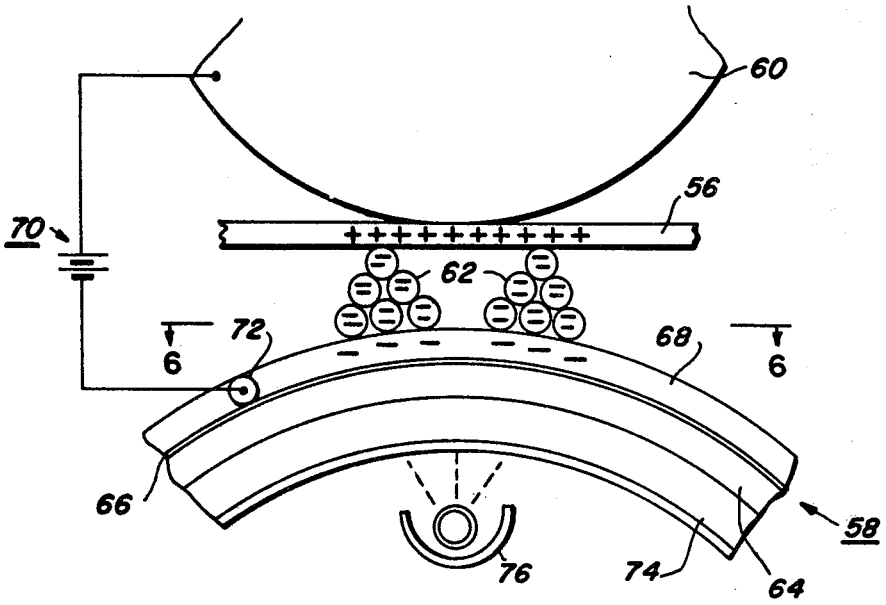
FIGS. 5 and 6 show an alternative embodiment in which the photoconductive layer of the photoreceptor is exposed through a transparent substrate.
Figure 6:
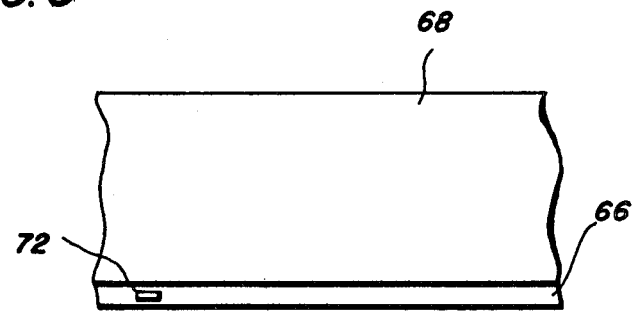

In accordance with the present invention, a photoconductive layer could also be exposed from the opposite side thereof by using a suitable transparent conductive substrate. FIGS. 5 and 6 show an alternative arrangement for effecting the same. As can be seen in FIG. 5, a transfer member 56 is moved between a flexible belt-type photoreceptor 58 and a conductive rubber roll 60 into contact with a toner image 62. The photoreceptor is comprised of a transparent substrate 64 made from a suitable material such as MYLAR, a thin light transmitting conductive metallic coating 66, and an ambipolar photoconductive layer 68 as described above. A voltage source 70 positively biases the roll 60, and negatively biases the photoconductive layer 68 through the metallic coating 66. As can be seen in both FIGS. 5 and 6, a contact roller 72 is in contact with the metallic coating 66 at all times to effect the biasing of the photoconductive layer 68. A transparent roll 74 along with at least one other roll supports the photoreceptor for movement around a closed path. A light source 76 is used to expose the photoconductive layer 68. Thus, three steps occur simultaneously: transfer member 56 in contact with the developed image is positively charged to attract the negatively charged toner 62 toward the transfer member, the photoconductive layer 68 is exposed to a suitable light source 76 while the photoconductive layer 68 is being negatively charged.

While the invention has been described with reference to the structure disclosed, it is not confined to the details set forth but is intended to cover such modifications or changes as may come within the scope of the following claims.

What is claimed is:

1. An electrostatic dry imaging process comprising providing a photoreceptor which comprises a support substrate having a photoconductive layer disposed thereon, applying a uniform electrostatic charge to the surface of said photoreceptor so as to produce an electrostatic latent image thereon, developing said latent image with toner particles said toner retaining a triboelectric charge opposite in polarity to the charge of said latent image, contacting said developed image with a transfer member, applying a potential to said transfer member of a polarity opposite to the polarity of the charge on the toner particles, reversing the polarity of the charge on the photoreceptor such that the polarity of said charge is the same as the polarity of the charge of the toner particles and opposite to the polarity of the charge of the transfer member so as to enhance the transfer of the toner particles in imagewise configuration to said transfer member.

2. The process as disclosed in claim 1, further including the step of exposing said photoconductive layer uniformally to light during said charge reversal step.

3. The process as disclosed in claim 2 wherein said charge reversal step and uniform light exposure step occur simultaneously.

4. The process ad disclosed in claim 3 wherein said uniform exposure takes place through said photoreceptor comprising a transparent photoconductive layer superimposed on a transparent support substrate.

5. The process as disclosed in claim 2 wherein said charging of the transfer member, the reverse polarity step of the photoreceptor and uniform exposing steps occur simultaneously.

6. The process as disclosed in claim 2 wherein the photocondictive layer is ambipolar.

* * * * *